US005439790A

United States Patent [19]

Muthyala et al.

[11] Patent Number: 5,439,790

[45] Date of Patent: * Aug. 8, 1995

[54] PHTHALIMIDE BLOCKED POST-PROCESSING STABILIZERS FOR PHOTOTHERMOGRAPHY

[75] Inventors: Ramaiah Muthyala, Mendota Heights; Raymond J. Kenney, Woodbury; Frank J. Manganiello, St. Paul; Kumars Sakizadeh, Woodbury; Sharon M. Simpson, Lake Elmo, all of Minn.

[73] Assignee: Minnesota Mining and Manufacturing Company, St. Paul, Minn.

[ * ] Notice: The portion of the term of this patent subsequent to Apr. 5, 2011 has been disclaimed.

[21] Appl. No.: 265,317

[22] Filed: Jun. 24, 1994

[51] Int. Cl.[6] ..... G03C 1/498

[52] U.S. Cl. ..... 430/619; 430/203; 430/607; 430/613

[58] Field of Search ..... 430/619, 203, 607, 613

[56] References Cited

U.S. PATENT DOCUMENTS

| | | | |
|---|---|---|---|
| 3,180,731 | 4/1965 | Roman et al. | 96/29 |
| 3,457,075 | 7/1969 | Morgan et al. | 96/67 |
| 3,531,286 | 9/1970 | Renfrew | 96/67 |
| 3,615,617 | 10/1971 | Muller-Bardorff | 96/109 |
| 3,674,478 | 7/1972 | Grasshoff et al. | 96/3 |
| 3,698,898 | 10/1972 | Grasshoff et al. | 96/3 |
| 3,761,270 | 9/1973 | Mauriac et al. | 96/77 |

(List continued on next page.)

FOREIGN PATENT DOCUMENTS

0588717A2 3/1994 European Pat. Off. ..... G03C 1/498

OTHER PUBLICATIONS

Amit, B and Patchornik A. *Israel Journal of Chemistry*, vol. 12, Nos. 1–2, 1974, pp. 103–113.

Barltrop, J. A., et al *Chemical Communication*, No. 22, 1966, pp. 822–823.

Okada, Keiji *J. Chem. Soc., Chem. Commun.*, 1989, pp. 1636–1637.

Okada, Keiji and Oda, Masaji *J. Am. Chem. Soc.*, vol. 110, No. 26, 1988, pp. 8736–8738.

Pillai, V. N. R. *Synthesis*, 1980, Georg Thieme Publishers; pp. 1–26.

Research Disclosure, May 1978, No. 16979 and 16977, pp. 66–69.

Research Disclosure, Jun., 1978, No. 17029, pp. 9–15.

Reserach Disclosure, Mar. 1989, No. 29963, pp. 208–214.

*Primary Examiner*—Thorl Chea

*Attorney, Agent, or Firm*—Gary L. Griswold; Walter N. Kirn; Gregory A. Evearitt

[57] ABSTRACT

Photothermographic elements having improved post-processing stabilty are described. These elements comprise a support bearing at least one photosensitive, image-forming photothermographic-emulsion layer comprising:

(a) a photosensitive silver halide;

(b) a non-photosensitive, reducible silver source;

(c) a reducing agent for said non-photosensitive, reducible silver source, (d) a binder; and (e) a compound capable of releasing a post-processing stabilizer having a nucleus of the formula:

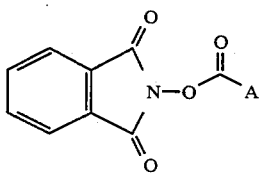

wherein:

A represents any monovalent group for which the corresponding compound AH functions as a post-processing stabilizer.

22 Claims, No Drawings

U.S. PATENT DOCUMENTS

| | | | |
|---|---|---|---|
| 3,791,830 | 2/1974 | Abele | 96/76 |
| 3,839,049 | 10/1974 | Simons | 96/114.6 |
| 3,844,797 | 10/1974 | Willems et al. | 96/114.1 |
| 3,993,661 | 11/1976 | Grasshoff et al. | 260/203 D |
| 4,009,029 | 2/1977 | Hammond et al. | 96/3 |
| 4,021,240 | 5/1977 | Cerquone et al. | 96/29 D |
| 4,022,617 | 5/1977 | McGuckin | 96/29 |
| 4,128,557 | 12/1978 | Knight et al. | 260/299 |
| 4,137,079 | 1/1979 | Houle | 96/55 |
| 4,138,265 | 2/1979 | Shino | 96/114.1 |
| 4,144,072 | 3/1979 | Ikenoue et al. | 96/114.1 |
| 4,245,033 | 1/1981 | Eida et al. | 430/353 |
| 4,260,677 | 4/1981 | Winslow et al. | 430/618 |
| 4,310,612 | 1/1982 | Mooberry et al. | 430/223 |
| 4,335,200 | 6/1982 | Ohashi et al. | 430/446 |
| 4,350,752 | 9/1982 | Reczek et al. | 430/219 |
| 4,351,896 | 9/1982 | Altland et al. | 430/354 |
| 4,378,424 | 3/1983 | Altland et al. | 430/352 |
| 4,404,390 | 9/1983 | Altland et al. | 548/263 |
| 4,416,977 | 11/1983 | Ohashi et al. | 430/446 |
| 4,420,554 | 12/1983 | Ohashi et al. | 430/446 |
| 4,451,561 | 5/1984 | Hirabayashi et al. | 430/619 |
| 4,460,681 | 7/1984 | Frenchik | 430/502 |
| 4,510,236 | 4/1985 | Gutman . | |
| 4,511,644 | 4/1985 | Okamura et al. | 430/219 |
| 4,678,735 | 7/1987 | Kitaguchi et al. | 430/203 |
| 4,734,353 | 3/1988 | Ono et al. | 430/613 |
| 4,837,141 | 6/1989 | Kohno et al. | 430/559 |
| 4,883,747 | 11/1989 | Grieve et al. | 430/542 |
| 4,888,268 | 12/1989 | Itoh et al. | 430/218 |
| 5,158,866 | 10/1992 | Simpson et al. | 430/617 |
| 5,175,081 | 12/1992 | Krepski et al. | 430/617 |
| 5,298,390 | 3/1994 | Sakizadeh et al. | 430/619 |
| 5,300,420 | 4/1994 | Kenny et al. | 430/613 |

PHTHALIMIDE BLOCKED POST-PROCESSING STABILIZERS FOR PHOTOTHERMOGRAPHY

BACKGROUND OF THE INVENTION

1. Field of Invention

This invention relates to novel, heat-developable photothermographic elements and in particular, it relates to phthalimide blocking groups for post-processing stabilizers for photothermographic elements.

2. Background to the Art

Silver halide-containing, photothermographic imaging materials (i.e., heat-developable photographic elements) processed with heat, and without liquid development, have been known in the art for many years. These materials, also known as "dry silver" compositions or emulsions, generally comprise a support having coated thereon: (a) a photosensitive material that generates silver atoms when irradiated; (b) a non-photosensitive, reducible silver source; (c) a reducing agent for the non-photosensitive, reducible silver source; and (d) a binder. The photosensitive material is generally photographic silver halide that must be in catalytic proximity to the non-photosensitive, reducible silver source. Catalytic proximity requires an intimate physical association of these two materials so that when silver atoms (also known as silver specks, clusters, or nuclei) are generated by irradiation or light exposure of the photographic silver halide, those nuclei are able to catalyze the reduction of the reducible silver source. It has long been understood that silver atoms ($Ag^{\circ}$) are a catalyst for the reduction of silver ions, and that the photosensitive silver halide can be placed into catalytic proximity with the non-photosensitive, reducible silver source in a number of different fashions. For example, catalytic proximity can be accomplished by partial metathesis of the reducible silver source with a halogen-containing source (see, for example, U.S. Pat. No. 3,457,075); by coprecipitation of silver halide and the reducible silver source material (see, for example, U.S. Pat. No. 3,839,049); and other methods that intimately associate the photosensitive, photographic silver halide and the non-photosensitive, reducible silver source.

The non-photosensitive, reducible silver source is a material that contains silver ions. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. Salts of other organic acids or other organic materials, such as silver imidazolates, have been proposed. U.S. Pat. No. 4,260,677 discloses the use of complexes of inorganic or organic silver salts as non-photosensitive, reducible silver sources.

In both photographic and photothermographic emulsions, exposure of the photographic silver halide to light produces small clusters of silver atoms ($Ag^{\circ}$). The imagewise distribution of these clusters is known in the art as a latent image. This latent image is generally not visible by ordinary means. Thus, the photosensitive emulsion must be further processed in order to produce a visible image. The visible image is produced by the reduction of silver ions which are in catalytic proximity to silver halide grains bearing the clusters of silver atoms, i.e., the latent image. This produces a black-and-white image.

As the visible image is produced entirely by elemental silver ($Ag^{\circ}$), one cannot readily decrease the amount of silver in the emulsion without reducing the maximum image density. However, reduction of the amount of silver is often desirable in order to reduce the cost of raw materials used in the emulsion and/or to enhance performance. For example, toning agents may be incorporated to improve the color of the silver image of the photothermographic element. Another method of increasing the maximum image density in photographic and photothermographic emulsions without increasing the amount of silver in the emulsion layer is by incorporating dye-forming materials in the emulsion. Upon imaging, the leuco dye is oxidized, and a dye and a reduced silver image are simultaneously formed in the exposed region. In this way, a dye-enhanced silver image can be produced.

A number of methods have been proposed for obtaining color images with dry silver systems. Such methods include, for example, incorporating dye-forming coupler materials into the dry silver systems and color-forming dry silver systems include: a combination of silver benzotriazole, a magenta, yellow, or cyan dye-forming coupler, an aminophenol developing agent, a base release agent such as guanidinium trichloroacetate, and silver bromide in poly(vinyl butyral); and a combination of silver bromoiodide, sulfonamidophenol reducing agent, silver behenate, poly(vinyl butyral), an amine such as n-octadecylamine, and 2-equivalent or 4-equivalent yellow, magenta or cyan dye-forming couplers.

Color images can also be formed by incorporation of dye forming or dye releasing compounds into the emulsion. Upon imaging, the dye forming or dye releasing material is oxidized and a dye and a reduced silver image are simultaneously formed in the exposed region.

For example, leuco dye compounds are often incorporated into the emulsion. A leuco dye is the reduced form of a color-bearing dye. It is generally colorless or very lightly colored. Upon imaging, the leuco dye is oxidized and a dye and a reduced silver image are simultaneously formed in the exposed region.

Multicolor photothermographic imaging elements typically comprise two or more monocolor-forming emulsion layers (often each emulsion layer comprises a set of bilayers containing the color-forming reactants) maintained distinct from each other by barrier layers. The barrier layer overlaying one photosensitive, photothermographic emulsion layer typically is insoluble in the solvent of the next photosensitive, photothermographic emulsion layer. Photothermographic elements having at least two or three distinct color-forming emulsion layers are disclosed in U.S. Pat. Nos. 4,021,240 and 4,460,681. Various methods to produce dye images and multicolor images with leuco dyes are well known in the art as represented by U.S. Pat. Nos. 3,180,731; 3,531,286; 3,761,270; 4,022,617; 4,460,681; 4,883,747; and *Research Disclosure* March 1989, item 29963.

One common problem that exists with photothermographic systems is post-processing instability of the image and/or of the background following processing. The photoactive silver halide still present in the developed image may continue to catalyze formation of metallic silver during room light handling. This is known as "silver print-out." Thus, there exists a need for stabilization of the unreacted silver halide. The addition of separate post-processing image stabilizers or stabilizer precursors provides the desired post-processing stability. Most often these are sulfur-containing compounds such as mercaptans, thiones, and thioethers as described in *Research Disclosure*, June 1978, item 17029. U.S. Pat. No. 4,245,033 describes sulfur compounds of the mercapto-type that are development restrainers of a photothermographic system. See also U.S. Pat. Nos. 4,837,141 and 4,451,561. Mesoionic 1,2,4-triazolium-3-thiolates as fixing agents and silver halide stabilizers are described in U.S. Pat. No. 4,378,424. Substituted 5-mercapto-1,2,4-triazoles, such as 3-amino-5-benzothio-l,2,4-triazole, used as post-processing stabilizers are described in U.S. Pat. Nos. 4,128,557; 4,137,079; 4,138,265; and *Research Disclosure* 16977 and 16979.

In color photothermographic elements, often unreacted dye forming or dye releasing compounds may slowly oxidize and form areas of color in the unexposed areas. In these elements, stabilizers are often added to reduce "leuco dye backgrounding."

Some of the problems with these stabilizers include thermal fogging during processing or losses in photographic sensitivity, maximum density, or contrast at effective stabilizer concentrations.

Stabilizer precursors have blocking or modifying groups that are usually cleaved during processing with heat and/or alkali. This provides the primary active stabilizer that can combine with the photoactive silver halide in the unexposed areas of the photographic material to form a light- and heat-stable complex. For example, in the presence of a stabilizer precursor in which the blocking group on the sulfur atom is cleaved upon processing, the resulting silver mercaptide will be more stable than the silver halide to light, atmospheric, and ambient conditions.

Various blocking techniques have been used in protecting stabilizer precursors in photographic elements. Removal of these blocking groups from the photographically useful stabilizers is accomplished by an increase of pH during alkaline processing conditions of the exposed imaging material. Thus, U.S. Pat. No. 3,615,617 describes acyl blocked photographically useful stabilizers. U.S. Pat. Nos. 3,674,478 and 3,993,661 describe hydroxyarylmethyl blocking groups. Benzylthio releasing groups are described in U.S. Pat. No. 3,698,898. Thiocarbonate blocking groups are described in U.S. Pat. No. 3,791,830, and thioether blocking groups in U.S. Pat. Nos. 4,335,200, 4,416,977, and 4,420,554. Photographically useful stabilizers that are blocked as urea or thiourea compounds are described in U.S. Pat. No. 4,310,612. Imidomethyl blocked stabilizers are described in U.S. Pat. No. 4,350,752, and imide or thioimide blocked stabilizers are described in U.S. Pat. No. 4,888,268.

Blocking groups that are thermally-sensitive have also been used. These blocking groups are removed by heating the imaging material during processing. Photographically useful stabilizers blocked with thermally-sensitive carbamate derivatives are described in U.S. Pat. Nos. 3,844,797 and 4,144,072. These carbamate derivatives presumably regenerate the photographic stabilizer through loss of an isocyanate. Hydroxymethyl blocked photographic reagents that are unblocked through loss of formaldehyde during heating are described in U.S. Pat. No. 4,510,236. Substituted benzylthio releasing groups are described in U.S. Pat. No. 4,678,735; and U.S. Pat. Nos. 4,351,896 and 4,404,390 use carboxybenzylthio blocking groups for mesoionic 1,2,4-triazolium-3-thiolates stabilizers. Photographic stabilizers that are blocked by a Michael-type addition to the carbon-carbon double bond of either acrylonitrile or alkyl acrylates are described in U.S. Pat. Nos. 4,009,029 and 4,511,644, respectively. Heating of these blocked derivatives causes unblocking by a retro-Michael reaction. U.S. Pat. No. 5,158,866 describes the use of omega-substituted 2-propionamidoacetal or 3-propionamidopropionyl stabilizer precursors as post-processing stabilizers in photothermographic elements. U.S. Pat. No. 5,175,081 describes the use of certain azlactones as stabilizers. U.S. Pat. No. 5,298,390 describes the use of certain alkyl sulfones as blocked compounds capable of releasing stabilizers with heat. U.S. Pat. No. 5,300,420 describes the use of certain nitriles as blocked compounds capable of releasing stabilizers with heat.

Various disadvantages attend these different blocking techniques. Highly basic solutions that are necessary to cause unblocking of the alkali-sensitive blocked derivatives are corrosive and irritating to the skin. With the photographic stabilizers that are blocked with a heat-removable group, it is often found that the liberated reagent of by-product, for example, acrylonitrile, can react with other components of the imaging construction and cause adverse effects. Also, inadequate or premature release of the stabilizing moiety within the desired time during processing may occur, resulting in fogging of the emulsion or loss of sensitivity.

Blocking groups which are removed by actinic radiation are discussed in the context of organic synthesis by Amit et al. *Israel J. Chem.* 1974, 12, 103; and V. N. R. Pillai *Synthesis* 1980, 1–26. Various substituted analogues have been prepared in order to maximize the photochemical efficiency and chemical yield, and to supress colored products of the photolysis.

The o-nitrobenzyl group has been known as a photocleavable blocking group for some time (see, J. Barltrop et al. *J. Chem. Soc. Chem. Commun.* 1966, 822–823). The o-nitrobenzyl group has been used to protect many different functional groups, including carboxylic acids, amines, phenols, phosphates, and thioIs.

European Laid Open Patent Application No. EP 588,717 describes the use of o-nitrobenzyl blocked stabilizers for photothermographic articles. These compounds stabilize the silver halide and/or minimize leuco dye oxidation without causing desensitization or fogging during heat processing. Deblocking to release the parent stabilizer is by actinic radiation and does not occur during processing or during shelf aging.

Although classical methods for the conversion of carboxylic acids to their corresponding hydrocarbons (such as the Hunsdiecker reaction) are well known, none have been used to photorelease stabilizers in photothermographic elements. Okada et al. *J. Amer. Chem. Soc.* 1988, 110, 8736, reported N-acyloxyphthalimides as excellent deblocking groups for carboxylic acids. Decarboxylation occurred readily with visible light $\lambda > 350$ nm. These authors also reported that decarboxylation can also be achieved using ultraviolet light in the presence of hindered bases such as 1,4-diazabicyclo[2.2.2]octane (DABCO), (see Okada et al. *J. Chem. Soc. Chem. Commun.* 1989, 1636). The authors used the N-acyloxyphthalimide group only for blocking carboxylic acids. Release of alcohols, amines, or sulfides such as those contained in photographic and photothermographic elements were not discussed.

Although phthalimidization techniques have found application in a small number of synthetic designs and technologies, phthalimide blocking groups have heretofore not been effectively employed in protecting the materials of photothermographic and dry-developable imaging. Thus, there has been a continued need for improved post-processing stabilizers that do not fog or desensitize the photographic materials, and stabilizer precursors that release the stabilizing moiety at the appropriate time and do not have any detrimental effects on the photosensitive material or user of the material.

SUMMARY OF THE INVENTION

The present invention provides heat-developable, photothermographic elements which are capable of providing high photographic speed; stable, high density images of high resolution and good sharpness; and good shelf stability.

The heat-developable, photothermographic elements comprise a support bearing at least one photosensitive, image-forming photothermographic emulsion layer comprising:

(a) a photosensitive silver halide;
(b) a non-photosensitive, reducible silver source;
(c) a reducing agent for the non-photosensitive, reducible silver source;
(d) a binder; and
(e) a compound capable of releasing a post-processing stabilizer having a nucleus of the formula:

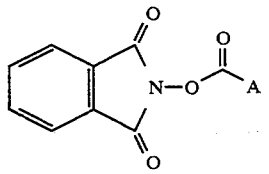

wherein:

A represents any monovalent group for which the corresponding compound AH functions as a post-processing stabilizer.

In the formula above, A represents any monovalent group for which the corresponding compound A—H functions as a post-processing stabilizer. The A groups may, of course, independently bear substituents that are photographically inert or physically useful (e.g., solubilizing, ballasting, etc.) and the substituent may be independently represented by a group R selected from hydrogen, alkyl, alkoxycarbonyl, alkenyl, aryl, hydroxy, mercapto, amino, amido, thioamido, carbamoyl, thiocarbamoyl, cyano, nitro, sulfo, carboxyl, fluoro, formyl, sulfoxyl, sulfonyl, hydrodithio, ammonium, phosphonio, and groups having up to 18 carbon atoms, and wherein any two or three R groups may together form a fused ring structure with any central benzene ring.

The reducing agent may also be a hindered phenol, hydroquinone, or other compound known as reducing agents for black-and-white photography. The reducing agent for the non-photosensitive silver source may optionally comprise a compound capable of being oxidized to form or release a dye. Preferably, the dye-forming material is a leuco dye.

The compounds of the present invention typically comprise from about 0.01 wt% to 10 wt% of the layer of the photothermographic element in which they are placed. They may be incorporated directly into the silver-containing layer, into an adjacent layer, or an image-receiving layer. The post-processing stabilizers of the invention are especially useful in elements and compositions for the preparation of photothermographic color and photothermographic black-and-white images.

The phthalimide-protected compounds of the present invention can be used in color and black-and-white photothermographic imaging systems such as so-called "Dry Silver" materials and successful blocking and post-processing release of the photothermographically useful materials allows for improved photothermographic products.

The addition of phthalimide-blocked compounds to the photothermographic emulsion layer or layer adjacent to the emulsion layer minimizes untimely leuco oxidation or stabilizes the silver halide for improved post-processing stabilization without desensitization or fogging the heat-developable photothermographic element and process.

The phthalimide-blocked post-processing stabilizers of the present invention are believed to be unblocked to release the parent stabilizer by the action of light. The light may be of any intensity. In one preferred procedure, the invention uses standard office lighting conditions to unblock the stabilizer. The blocking group is released as phthalimide and carbon dioxide.

The phthalimide-protected post-processing stabilizers offer advantages over unprotected stabilizers and stabilizers released by other mechanisms by being inert and inactive during emulsion-forming, coating, drying, prolonged storage, and processing. The photothermographically useful material is released only when needed. They are useful in a wide range of photothermographic media and processing conditions since they do not appear to have specific requirements for release that attend most other blocking groups. The compounds of this invention provide improved post-processing image stability with little or no effect on the imaging properties of the photothermographic element.

As used herein, the term "phthalimide nucleus" means a group having the following structure:

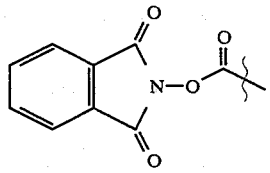

When a general structure is referred to as "a compound having the nucleus of" a given formula, any substitution which does not alter the bond structure of the formula or the shown atoms within that structure, is included within that structure. For example, where a phthalimide structure is shown, substituent groups may be placed on the phthalimide structure, but the conjugation of the ring may not be altered and the atoms forming the phthalimide ring skeleton may not be replaced.

When a general structure is referred to as "a general formula" it does not specifically allow for such broad substitution of the structure.

As is well understood in this area, substitution is not only tolerated, but is often advisable and substitution is anticipated on the compounds used in the present invention. As a means of simplifying the discussion and recitation of certain substituent groups, the terms "group" and "moiety" are used to differentiate between those chemical species that may be substituted and those which may not be so substituted. Thus, when the term "group," or "aryl group," is used to describe a substituent, that substituent includes the use of additional substituents beyond the literal definition of the basic group. Where the term "moiety" is used to describe a substituent, only the unsubstituted group is intended to be included. For example, the phrase, "alkyl group" is intended to include not only pure hydrocarbon alkyl chains, such as methyl, ethyl, propyl, t-butyl, cyclohexyl, iso-octyl, octadecyl and the like, but also alkyl chains beating substituents known in the art, such as hydroxyl, alkoxy, phenyl, halogen atoms (F, CI, Br, and I), cyano, nitro, amino, carboxy, etc. For example, alkyl group includes ether groups (e.g., $CH_3_CH_2_CH_2_O—CH_2_$), haloalkyls, nitroalkyls, carboxyalkyls, hydroxyalkyls, sulfoalkyls, etc. On the other hand, the phrase "alkyl moiety" is limited to the inclusion of only pure hydrocarbon alkyl chains, such as methyl, ethyl, propyl, t-butyl, cyclohexyl, iso-octyl, octadecyl, and the like. Substituents that react with active ingredients, such as very strongly electrophilic or oxidizing substituents, would of course be excluded by the ordinarily skilled artisan as not being inert or harmless.

As used herein, the term "emulsion layer" means a layer of a photothermographic element that contains photosensitive silver salt and silver source material. As used herein the term "photothermographic element" means a construction comprising at least one photothermographic emulsion layer and any supports, topcoat layers, image receiving layers, blocking layers, etc.

Other aspects, advantages, and benefits of the present invention are apparent from the detailed description, examples, and claims.

DETAILED DESCRIPTION OF THE INVENTION

The present invention provides heat-developable, photothermographic elements capable of providing stable, high density images of high resolution. These heat-developable, photothermographic elements comprise a support bearing at least one photosensitive, image-forming photothermographic emulsion layer comprising:

(a) a photosensitive silver halide;
(b) a non-photosensitive, reducible silver source;
(c) a reducing agent for the non-photosensitive, reducible silver source;
(d) a binder; and
(e) a compound capable of releasing a post-processing stabilizer having a nucleus of the formula:

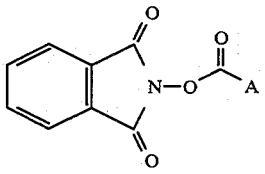

wherein:

A represents any monovalent group for which the corresponding compound AH functions as a post-processing stabilizer.

In the formula above, A represents a group in which a hydrogen atom of the corresponding compound A—H, which is a post-processing stabilizer for the reducing agent for the non-photosensitive reducible source of silver, or a post-processing stabilizer for the non-photosensitive reducible silver source, has been replaced by:

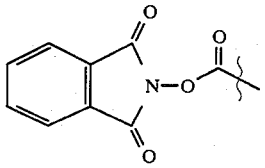

In general, A represents any monovalent group having from 1 to 50 carbon atoms and for which the corresponding compound A—H functions as a post-processing stabilizer. The A groups may of course independently bear substituents that are photographically inert or physically useful (e.g., solubilizing, ballasting, etc.) and the substituent may be independently represented by a group R selected from hydrogen, alkyl, alkoxycarbonyl, alkenyl, aryl, hydroxy, mercapto, amino, amido, thioamido, carbamoyl, thiocarbamoyl, cyano, nitro, sulfo, carboxyl, fluoro, formyl, sulfoxyl, sulfonyl, hydrodithio, ammonium, phosphonio, and groups having up to 18 carbon atoms in any one of these groups, and wherein any two or three R groups may together form a fused ring structure with any central benzene ring.

In such stabilizing groups, A—H usually has a heteroatom such as nitrogen or oxygen available for complexing silver ion. The compounds are usually ring structures with the heteroatom within the ring or external to the ring.

In one embodiment the compound A—H represents a compound that functions as a post-processing stabilizer for black-and-white phtothermographic elements and prevents "silver print-out." Non-limiting examples of A—H include nitrogen-containing heterocycles, substituted or unsubstituted, including but not limited to, imidazoles such as benzimidazole and benzimidazole derivatives; triazoles such as benzotriazole, 1,2,4-triazole, 3-amino-l,2,4-triazole, and 3-alkylthio-5-phenyl-1,2,4-triazoles; tetrazoles such as 5-amino-tetrazole and phenylmercaptotetrazole; triazines such as mercaptotetrahydrotriazine; piperidones; tetraazaindans; 8-azaguanine; thymine; thiazolines such as 2-amino-2-thiazoline, indazoles; hypoxanthines; pyrazolidinones; 2H-pyridoxazin-3(4H)-one and other nitrogen-containing heterocycles; or any such compound that stabilizes the emulsion layer, and particularly those that have deleterious effects on the initial sensitometry or excessive fog if used unblocked. Non limiting examples of A—H that include oxygen-containing compounds such as phenols or hydroxyarylalkanes.

In a preferred embodiment of the invention, A—H is a post-processing stabilizer identified to be most advantageous for a given photothermographic construction; for instance, 1,1,1-tris-(4-hydroxyphenyl)ethane, benzotriazole, or 3-($\eta$-hexylthio)-5-phenyl- 1,2,4-triazole.

Non-limiting representative examples of stabilizer groups A for preventing "silver print-out" in black-and-white photothermographic elements according to the present invention are:

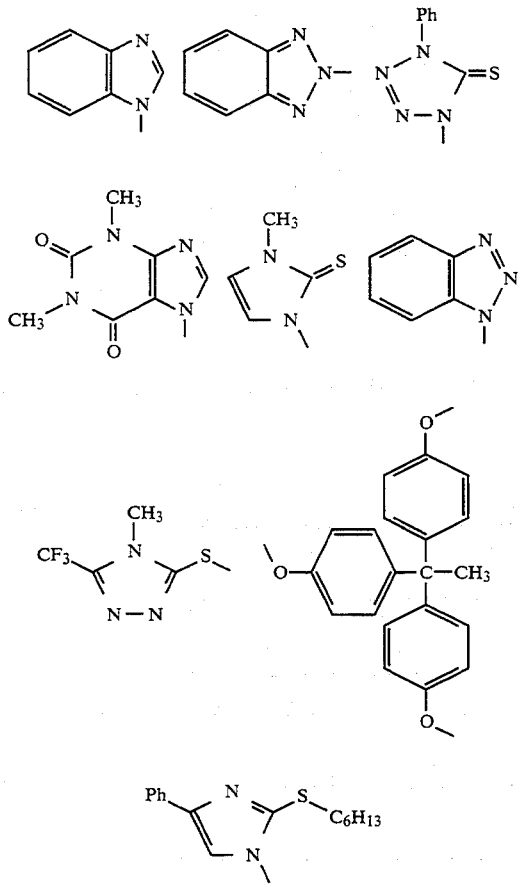

In another embodiment, the group A represents the nucleus of a post-processing stabilizing group for stabilizing the reducing agent that is capable of being oxidized to form or release a dye. Often unreacted dye forming or dye releasing compound may slowly oxidize and form areas of color in the unexposed areas. Such stabilizers prevent "leuco dye backgrounding." Many of such stabilizer compounds are summarized in *Research Disclosure*, March 1989, item 29963. Thus, A—H may also be a compound that stabilizes a leuco dye, usually a reducing agent that has an active hydrogen that can be masked by replacement with the blocking group. A preferred example of a useful reducing agent is 1-phenyl-3-pyrazolidinone (phenidone) as described in U.S. Pat. No. 4,423,139 for stabilizing leuco dyes. Blocking of such reducing agents during the processing step is usually necessary since they may act as developers or development accelerators to cause unacceptable fogging.

Non-limiting representative examples of post-processing stabilizer groups A for preventing "leuco dye backgrounding" of color photothermographic elements to the present invention are:

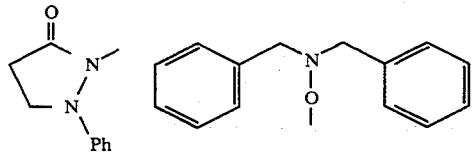

A is preferably attached to the blocking group containing a phthalimide nucleus through a nitrogen, sulfur, or oxygen atom. It will be appreciated that the "phthalimide nucleus" is capable of substitution, particularly on the benzene ring portion of the nucleus.

The phthalimide group acts as a blocking group to inhibit or suppress the activity of the post-processing stabilizer A—H. If A—H is left unblocked and added to the photothermographic emulsion at the same molar equivalent concentration as the blocked compound, A—H desensitizes, fogs, reacts with, destabilizes, or otherwise has a deleterious effect on the emulsion or its photothermographic properties. Unblocking to release the active post-processing stabilizer occurs after imaging and during subsequent exposure to ambient light. Thus, the blocked post-processing stabilizers of the present invention overcome the problems of desensitization, fogging, and instability of the emulsion that occur when the post-processing stabilizers are used in their unblocked form.

In photothermographic elements of the present invention, the layer(s) that contain the photographic silver salt are referred to herein as emulsion layer(s). According to the present invention, the blocked post-processing stabilizer is added either to one or more emulsion layers or to a layer or layers adjacent to one or more emulsion layers. Layers that are adjacent to emulsion layers may be, for example, protective topcoat layers, primer layers, image-receiving layers, interlayers, opacifying layers, antihalation layers, barrier layers, auxiliary layers, etc. It is preferred that the blocked post-processing stabilizer be present in the photothermographic emulsion layer, topcoat layer, or image receiving layer.

The photothermographic elements of this invention may be used to prepare black-and-white, monochrome, or full color images. The photothermographic material of this invention can be used, for example, in conventional black-and-white or color photothermography, in electronically generated black-and-white or color hard copy recording, in the graphic arts area, and in digital color proofing. The material of this invention provides high photographic speed, provides strongly absorbing black-and-white or color images, and provides a dry and rapid process.

Photothermographic elements of the invention may contain other post-processing stabilizers or stabilizer precursors in combination with the compounds of the invention, as well as other additives in combination with the compounds of the invention such as shelf-life stabilizers, toners, development accelerators, and other image-modifying agents.

The amounts of the above-described post-processing stabilizer ingredients that are added to the photothermographic element of the present invention may be varied depending upon the particular compound used, upon the type of emulsion layer (e.g., black-and-white vs. color), and whether the stabilizer is located in the emulsion layer, topcoat layer, or image receiving layer. However, the ingredients are preferably added in an amount of 0.01 to 100 mole per mole of silver halide, and more preferably from 0.1 to 50 mole per mole of silver halide, in the emulsion layer.

The Photosensitive Silver Halide

As noted above, the present invention includes a photosensitive silver halide in the photothermographic construction. The photosensitive silver halide can be any photosensitive silver halide, such as silver bromide, silver iodide, silver chloride, silver bromoiodide, silver chlorobromoiodide, silver chlorobromide, etc. The photosensitive silver halide can be added to the emulsion layer in any fashion so long as it is placed in catalytic proximity to the organic silver compound which serves as a source of reducible silver.

The light sensitive silver halide used in the present invention can be employed in a range of about 0.005 mole to about 0.5 mole and, preferably, from about 0.01 mole to about 0.15 mole per mole of non-photosensitive reducible silver salt.

The silver halide used in the present invention may be employed without modification. However, it can be chemically and spectrally sensitized in a manner similar to that used to sensitize conventional wet process silver halide or state-of-the-art heat-developable photographic materials. For example, it may be chemically sensitized with a chemical sensitizing agent, such as a compound containing sulfur, selenium, tellurium, etc., or a compound containing gold, platinum, palladium, ruthenium, rhodium, iridium, etc., a reducing agent such as a tin halide, etc., or a combination thereof. The details of these procedures are described in T. H. James *The Theory of the Photographic Process*, Fourth Edition, Chapter 5, pages 149 to 169. Suitable chemical sensitization procedures are also described in Shepard, U.S. Pat. No. 1,623,499; Waller, U.S. Pat. No. 2,399,083; McVeigh, U.S. Pat. No. 3,297,447; and Dunn, U.S. Pat. No. 3,297,446.

The silver halide may be preformed by any means, e.g., in accordance with U.S. Pat. No. 3,839,049. Methods of preparing these silver halide and organic silver salts and manners of blending them are described in *Research Disclosure*, June, 1978, item 17029; U.S. Pat. Nos. 3,700,458 and 4,076,539; and Japanese patent application Nos. 13224/74, 17216/75, and 42529/76, Preformed silver halide emulsions when used in the material of this invention can be unwashed or washed to remove soluble salts. In the latter case the soluble salts can be removed by chill-setting and leaching or the emulsion can be coagulation washed, e.g., by the procedures described in U.S. Pat. Nos. 2,618,556; 2,614,928; 2,565,418; 3,241,969; and 2,489,341. The silver halide grains may have any crystalline habit including, but not limited to, cubic, tetrahedral, orthorhombic, tabular, laminar, platelet, etc. The silver halide grains may have a uniform ratio of halide throughout; they may have a graded halide content, with a continuously varying ratio of, for example, silver bromide and silver iodide; or they may be of the core-shell-type, having a discrete core of one halide ratio, and a discrete shell of another halide ratio.

It is also effective to use an in situ process, i.e., a process in which a halogen-containing compound is added to an organic silver salt to partially convert the silver of the organic silver salt to silver halide.

The photosensitive silver halides may be spectrally sensitized with various known dyes that spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Of these dyes, cyanine dyes, merocyanine dyes, and complex merocyanine dyes are particularly useful.

An appropriate amount of sensitizing dye added is generally about $10^{-10}$ to $10^{-1}$ mole, and preferably about $10^{-8}$ to $10^{-3}$ moles per mole of silver halide.

The Non-Photosensitive Reducible Silver Source Material

The non-photosensitive reducible silver source that can be used in the present invention can be any material that contains a source of reducible silver ions. Preferably, it is a silver salt which is comparatively stable to light and forms a silver image when heated to 80° C. or higher in the presence of an exposed photocatalyst (such as silver halide) and a reducing agent. Salts of organic acids, such as the silver salt of behenic acid, or other salts of organic materials, such as silver imidazolates, have been proposed, and U.S. Pat. No. 4,260,677 discloses the use of complexes of inorganic or organic silver salts as non-photosensitive, reducible silver sources. Complexes of organic or inorganic silver salts, wherein the ligand has a gross stability constant for silver ion of about 4.0–10.0, are also useful in this invention.

Silver salts of organic acids, particularly silver salts of long chain fatty carboxylic acids, are preferred. The chains typically contain 10 to 30, preferably 15 to 28, carbon atoms. Suitable organic silver salts include silver salts of organic compounds having a carboxyl group. Examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate, silver camphorate, and mixtures thereof, etc. Silver salts that can be substituted with a halogen atom or a hydroxyl group also can be effectively used. Preferred examples of the silver salts of aromatic carboxylic acid and other carboxyl group-containing compounds include: silver benzoate, a silver-substituted benzoate, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc.; silver gallate; silver tannate; silver phthalate; silver terephthalate; silver salicylate; silver phenylacetate; silver pyromellilate; a silver salt of 3-carboxymethyl-4-methyl-4-thiazoline-2-thione or the like as described in U.S. Pat. No. 3,785,830; and a silver salt of an aliphatic carboxylic acid containing a thioether group as described in U.S. Pat. No. 3,330,663.

Silver salts of compounds containing mercapto or thione groups and derivatives thereof can also be used. Preferred examples of these compounds include: a silver salt of 3-mercapto-4-phenyl-1,2,4-triazole; a silver salt of 2-mercaptobenzimidazole; a silver salt of 2-mercapto-5-aminothiadiazole; a silver salt of 2-(2-ethylglycolamido)benzothiazole; a silver salt of thioglycolic acid, such as a silver salt of a S-alkylthioglycolic acid (wherein the alkyl group has from 12 to 22 carbon atoms); a silver salt of a dithiocarboxylic acid such as a silver salt of dithioacetic acid; a silver salt of thioamide; a silver salt of 5-carboxylic-1-methyl-2-phenyl-4-thiopyridine; a silver salt of mercaptotriazine; a silver salt of 2-mercaptobenzoxazole; a silver salt as described in U.S. Pat. No. 4,123,274, for example, a silver salt of a 1,2,4-mercaptothiazole derivative, such as a silver salt of 3-amino-5-benzyl-thio-1,2,4-thiazole; and a silver salt of a thione compound, such as a silver salt of 3-(2-carboxyethyl)-4-methyl-4-thiazoline-2-thione as disclosed in U.S. Pat. No. 3,201,678. Silver salts of acetylenes can also be used. Silver acetylides are described in U.S. Pat. Nos. 4,761,361 and 4,775,613.

Furthermore, a silver salt of a compound containing an imino group can be used. Preferred examples of these compounds include: silver salts of benzotriazole and substituted derivatives thereof, for example silver methylbenzotriazole and silver 5-chlorobenzotriazole, etc.; silver salts of 1,2,4-triazoles or 1-H-tetrazoles as described in U.S. Pat. No. 4,220,709; and silver salts of imidazoles and imidazole derivatives.

It is also found convenient to use silver half soaps. A preferred example of a silver half soap is an equimolar blend of silver behenate and behenic acid, which analyzes for about 14.5% silver and which is prepared by precipitation from an aqueous solution of the sodium salt of commercial behenic acid. Transparent sheet materials made on transparent film backing require a transparent coating. For this purpose a silver behenate full soap, containing not more than about 4 or 5 percent of free behenic acid and analyzing about 25.2 percent silver, can be used.

The method used for making silver soap dispersions is well known in the art and is disclosed in *Research Disclosure*, April 1983, item 22812, *Research Disclosure*, October 1983, item 23419, and U.S. Pat. No. 3,985,565.

The silver halide and the non-photosensitive reducible silver source material that form a starting point of development should be in catalytic proximity, i.e., reactive association. By "catalytic proximity" or "reactive association" is meant that they should be in the same layer, in adjacent layers, or in layers separated from each other by an intermediate layer having a thickness of less than 1 micrometer (1 μm). It is preferred that the silver halide and the non-photosensitive reducible silver source material be present in the same layer.

Photothermographic emulsions containing preformed silver halide in accordance with this invention can be sensitized with chemical sensitizers, or with spectral sensitizers as described above.

The source of reducible silver material generally constitutes about 5 to about 70 percent by weight of the emulsion layer. It is preferably present at a level of about 10 to about 50 percent by weight of the emulsion layer.

The Reducing Agent for the Non-Photosensitive Reducible Silver Source

The reducing agent for the organic silver salt may be any material, preferably organic material, that can reduce silver ion to metallic silver. Conventional photographic developers such as phenidone, hydroquinones, and catechol are useful, but hindered bisphenol reducing agents are preferred.

A wide range of reducing agents has been disclosed in dry silver systems including amidoximes, such as phenylamidoxime, 2-thienylamidoxime and p-phenoxyphenylamidoxime; azines, such as 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; a combination of polyhydroxybenzene and hydroxylamine; a reductone and/or a hydrazine, such as a combination of hydroquinone and bis(ethoxyethyl)hydroxylamine, piperidinohexose reductone, or formyl-4-methylphenylhydrazine; hydroxamic acids, such as phenylhydroxamic acid, p-hydroxyphenylhydroxamic acid, and o-alaninehydroxamic acid; a combination of azines and sulfonamidophenols, such as phenothiazine and p-benzenesulfonamidophenol, and 2,6-dichloro-4-benzenesulfonamidophenol; α-cyanophenylacetic acid derivatives, such as ethyl α-cyano-2-methylphenylacetate, ethyl α-cyano-phenylacetate; bis-o-naphthols, such as by 2,2'-dihydroxyl-1-binaphthyl, 6,6'-dibromo-2,2'-dihydroxy-1,1'-binaphthyl, and bis(2-hydroxy-1-naphthyl)methane; a combination of bis-o-naphthol and a 1,3-dihydroxybenzene derivative, such as 2,4-dihydroxybenzophenone or 2,4-dihydroxyacetophenone; 5-pyrazolones such as 3-methyl-1-phenyl-5-pyrazolone; reductones, such as dimethylaminohexose reductone, anhydrodihydroaminohexose reductone, and anhydrodihydro-piperidone-hexose reductone; sulfonamidophemol reducing agents, such as 2,6-dichloro-4-benzenesulfonamidophenol and p-benzenesulfonamidophenol; indane-1,3-diones, such as 2-phenylindane-1,3-dione; chromans, such as 2,2-dimethyl-7-t-butyl-6-hydroxychroman; 1,4-dihydropyridines, such as 2,6-dimethoxy-3,5-dicarbethoxy- 1,4-dihydropyridine; bisphenols, such as bis(2-hydroxy-3-t-butyl-5-methylphenyl)methane, 1,1-bis(2-hydroxy-3,5-dimethyl-phenyl)-3,5,5-trimethylhexane, 2,2-bis(4-hydroxy-3-methylphenyl)propane, 4,4-ethylidene-bis(2-t-butyl-6-methylphenol), and 2,2-bis(3,5-dimethyl-4-hydroxyphenyl)propane; ascorbic acid derivatives, such as 1-ascorbylpalmitate, ascorbylstearate; unsaturated aldehydes and ketones; and 3-pyrazolidones.

The reducing agent should be present as 1 to 10 % by weight of the imaging layer. In multilayer constructions, if the reducing agent is added to a layer other than an emulsion layer, slightly higher proportions, of from about 2 to 15%, tend to be more desirable.

The Optional Dye-Forming or Dye-Releasing Material

As noted above, the reducing agent for the reducible source of silver may be a compound that can be oxidized directly or indirectly to form or release a dye.

When the photothermographic element used in this invention is heat developed, preferably at a temperature of from about 80° C. to about 250° C. (176° F. to 482° F.) for a duration of from about 0.5 to about 300 seconds, in a substantially water-free condition after, or simultaneously with, imagewise exposure, a mobile dye image is obtained simultaneously with the formation of a silver image either in exposed areas or in unexposed areas with exposed photosensitive silver halide.

Leuco dyes are one class of dye-forming material that form a dye upon oxidation. Any leuco dye capable of being oxidized by silver ion to form a visible image can be used in the present invention. Leuco dyes that are both pH sensitive and oxidizable can also be used, but are not preferred. Leuco dyes that are sensitive only to changes in pH are not included within scope of dyes useful in this invention because they are not oxidizable to a colored form.

As used herein, a "leuco dye" or "blocked leuco dye" is the reduced form of a dye that is generally colorless or very lightly colored and is capable of forming a colored image upon oxidation of the leuco or blocked leuco dye to the dye form. Thus, the blocked leuco dyes (i.e., blocked dye-releasing compounds), absorb less strongly in the visible region of the electromagnetic spectrum than do the dyes. The resultant dye produces an image either directly on the sheet on which the dye is formed or, when used with a dye- or image-receiving layer, on the image-receiving layer upon diffusion through emulsion layers and interlayers.

Representative classes of leuco dyes that can used in the photothermographic elements of the present invention include, but are not limited to: chromogenie leuco dyes, such as indoaniline, indophenol, or azomethine leuco dyes; imidazole leuco dyes, such as 2-(3,5-di-t-butylo4-hydroxyphenyl)-4,5-diphenylimidazole, as described in U.S. Pat. No. 3,985,565; dyes having an azine, diazine, oxazine, or thiazine nucleus such as those described in U.S. Pat. Nos. 4,563,415; 4,622,395; 4,710,570; and 4,782,010; and benzylidene leuco compounds as described in U.S. Pat. No. 4,923,792.

A preferred class of leuco dyes useful in this invention are those derived from azomethine leuco dyes or indoaniline leuco dyes. These are often referred to herein as "chromogenic leuco dyes" because many of these dyes are useful in conventional, wet-processed photography. Chromogenic dyes are prepared by oxidative coupling of a p-phenylenediamine compound or a p-aminophenol compound with a photographic-type coupler. Reduction of the corresponding dye as described, for example, in U.S. Pat. No. 4,374,921 forms the chromogenic leuco dye. Leuco chromogenic dyes are also described in U.S. Pat. No. 4,594,307. Cyan leuco chromogenic dyes having short chain carbamoyl protecting groups are described in European Laid Open Patent Application No. 533,008. For a review of chromogenic leuco dyes, see K. Venkataraman, *The Chemistry of Synthetic Dyes*, Academic Press: New York, 1952; Vol. 4, Chapter VI.

Another class of leuco dyes useful in this invention are "aldazine" and "ketazine" leuco dyes. Dyes of this type are described in U.S. Pat. No. 4,587,211 and 4,795,697. Benzylidene leuco dyes are also useful in this invention. Dyes of this type are described in U.S. Pat. No. 4,923,792.

Yet another class of dye-releasing materials that form a diffusible dye upon oxidation are known as preformed-dye-release (PDR) or redox-dye-release (RDR) materials. In these materials, the reducing agent for the organic silver compound releases a mobile pre-formed dye upon oxidation. Examples of these materials are disclosed in Swain, U.S. Pat. No. 4,981,775.

Further, as other image-forming materials, materials where the mobility of the compound having a dye part changes as a result of an oxidation-reduction reaction with silver halide, or an organic silver salt at high temperature can be used, as described in Japanese Patent Application No. 165,054/84.

Still further the reducing agent may be a compound that releases a conventional photographic dye coupler or developer on oxidation as is known in the art.

The dyes formed or released in the various color-forming layers should, of course, be different. A difference of at least 60 nm in reflective maximum absorbance is preferred. More preferably, the absorbance maximum of dyes formed or released will differ by at least 80–100 nm. When three dyes are to be formed, two should preferably differ by at least these minimums, and the third should preferably differ from at least one of the other dyes by at least 150 nm, and more preferably, by at least 200 nm. Any reducing agent capable of being oxidized by silver ion to form or release a visible dye is useful in the present invention as previously noted.

The total amount of optional leuco dye used as a reducing agent used in the present invention should preferably be in the range of 0.5–25 weight percent, and more preferably, in the range of 1–10 weight percent, based upon the total weight of each individual layer in which the reducing agent is employed.

The Binder

The photosensitive silver halide, the non-photosensitive reducible source of silver, the reducing agent, the phthalimide blocked stabilizer, and other addenda used in the present invention are generally added to at least one binder. The binder(s) that can be used in the present invention can be employed individually or in combination with one another. It is preferred that the binder be selected from polymeric materials, such as, for example, natural and synthetic resins that are sufficiently polar to hold the other ingredients in solution or suspension. The binder can be hydrophilic or hydrophobic, preferably it is hydrophobic.

A typical hydrophilic binder is a transparent or translucent hydrophilic colloid. Examples of hydrophilic binders include: a natural substance, for example, a protein such as gelatin, a gelatin derivative, a cellulose derivative, etc.; a polysaccharide such as starch, gum arabic, pullulan, dextrin, etc.; and a synthetic polymer, for example, a water-soluble polyvinyl compound such as poly(vinyl alcohol), poly(vinyl pyrrolidone), acrylamide polymer, etc. Another example of a hydrophilic binder is a dispersed vinyl compound in latex form which is used for the purpose of increasing dimensional stability of a photographic element.

Examples of typical hydrophobic binders are polyvinyl acetals, polyvinyl chloride, polyvinyl acetate, cellulose acetate, polyolefins, polyesters, polystyrene, polyacrylonitrile, polycarbonates, methacrylate copolymers, maleic anhydride ester copolymers, butadiene-styrene copolymers, and the like. Copolymers, e.g., terpolymers, are also included in the definition of polymers. The polyvinyl acetals, such as poly(vinyl butyral) and poly(vinyl formal), and vinyl copolymers such as poly(vinyl acetate) and poly(vinyl chloride) are particularly preferred.

The binders are preferably used at a level of about 30–90 percent by weight of the emulsion layer, and more preferably at a level of about 45–85 percent by weight. Where the proportions and activities of the reducing agent for the non-photosensitive reducible source of silver require a particular developing time and temperature, the binder should be able to withstand those conditions. Generally, it is preferred that the binder not decompose or lose its structural integrity at 250° F. (121° C.) for 60 seconds, and more preferred that it not decompose or lose its structural integrity at 350° F. (177° C.) for 60 seconds.

Optionally, these polymers may be used in combination of two or more thereof. Such a polymer is used in an amount sufficient to carry the components dispersed therein, that is, within the effective range of the action as the binder. The effective range can be appropriately determined by one skilled in the art.

Photothermographic Formulations

The formulation for the photothermographic emulsion layer can be prepared by dissolving and dispersing the binder, the photosensitive silver halide, the non-photosensitive reducible source of silver, the reducing agent for the non-photosensitive reducible silver source, and optional additives, in an inert organic solvent, such as, for example, toluene, 2-butanone, or tetrahydrofuran.

The use of "toners" or derivatives thereof which improve the image, is highly desirable, but is not essential to the element. Toners can be present in an amount of about 0.01–10 percent by weight of the emulsion layer, preferably about 0.1–10 percent by weight. Toners are well known materials in the photothermographic art, as shown in U.S. Pat. No. 3,080,254; 3,847,612; and 4,123,282.

Examples of toners include: phthalimide and N-hydroxyphthalimide; cyclic imides, such as succinimide, pyrazoline-5-ones, quinazolinone, 1-phenylurazole, 3-phenyl-2-pyrazoline-5-one, and 2,4o-thiazolidinedione; naphthalimides, such as N-hydroxy-1,8-naphthalimide; cobalt complexes, such as cobaltic hexamine trifluoroacetate; mercaptans such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, such as (N,N-dimethylaminomethyl)phthalimide, and N-(dimethylaminomethyl)naphthalene-2,3-dicarboximide; a combination of blocked pyrazoles, isothiuronium derivatives, and certain photobleach agents, such as a combination of N,N'-hexamethylene-bis(1-carbamoyl-3,5-dimethylpyrazole), 1,8-(3,6-diazaoctane)bis-(isothiuronium)trifluoroacetate and 2-(tribromomethylsulfonyl benzothiazole); merocyanine dyes such as 3-ethyl-5-[(3-ethyl-2-benzothiazolinylidene)-1-methylethylidene]-2-thio-2,4-o-azolidinedione; phthalazinone, phthalazinone derivatives, or metal salts or these derivatives, such as 4-(1-naphthyl)phthalazinone, 6-chlorophthalazinone, 5,7-dimethoxyphthalazinone, and 2,3-dihydro-1,4-phthalazinedione; a combination of phthalazine plus one or more phthalic acid derivatives, such as phthalic acid, 4-methylphthalic acid, 4-nitrophthalic acid, and tetrachlorophthalic anhydride, quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate, and potassium hexachlororhodate (III); inorganic peroxides and persulfates, such as ammonium peroxydisulfate and hydrogen peroxide; benzoxazine-2,4-diones, such as 1,3-benzoxazine-2,4-dione, 8-methyl-1,3-benzoxazine-2,4odione, and 6-nitro-1, 3-benzoxazine-2,4-dione; pyrimidines and asym-triazines, such as 2,4-dihydroxypyrimidine, 2-hydroxy-4-aminopyrimidine, and azauracil; and tetrazapentalene derivatives, such as 3,6-dimercapto-1,4-diphenyl-1H, 4H-2,3a,5,6a-tetraazapentalene and 1,4-di(o-chlorophenyl)-3,6-dimercapto-1H,4H-2,3a,5,6a-tetraazapentalene.

The photothermographic elements used in this invention can be further protected against the additional production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide.

Other suitable antifoggants and stabilizers, which can be used alone or in combination, include the thiazolium salts described in U.S. Pat. No. 2,131,038 and U.S. Pat. No. 2,694,716; the azaindenes described in U.S. Pat. No. 2,886,437; the triazaindolizines described in U.S. Pat. No. 2,444,605; the mercury salts described in U.S. Pat. No. 2,728,663; the urazoles described in U.S. Pat. No. 3,287,135; the sulfocatechols described in U.S. Pat. No. 3,235,652; the oximes described in British Patent No. 623,448; the polyvalent metal salts described in U.S. Pat. No. 2,839,405; the thiuronium salts described in U.S. Pat. No. 3,220,839; and palladium, platinum and gold salts described in U.S. Pat. Nos. 2,566,263 and 2,597,915.

Photothermographic elements of the invention can contain plasticizers and lubricants such as polyalcohols and diols of the type described in U.S. Pat. No. 2,960,404; fatty acids or esters, such as those described in U.S. Pat. Nos. 2,588,765 and 3,121,060; and silicone resins, such as those described in British Patent No. 955,061.

The photothermographic elements of the present invention can also include image dye stabilizers. Such image dye stabilizers are illustrated by U.K. Patent No. 1,326,889; and U.S. Pat. No. 3,432,300; 3,698,909; 3,574,627; 3,573,050; 3,764,337; and 4,042,394.

Photothermographic elements according to the present invention can further contain light-absorbing materials, antihalation, acutance, and filter dyes such as those described in U.S. Pat. No. 3,253,921; 2,274,782; 2,527,583; 2,956,879, 5,266,452, and 5,314,795. If desired, the dyes can be mordanted, for example, as described in U.S. Pat. No. 3,282,699. They can also contain matting agents such as starch, titanium dioxide, zinc oxide, silica, and polymeric beads including beads of the type described in U.S. Pat. No. 2,992,101 and 2,701,245. Furthermore they can also contain antistatic or conducting layers, such as layers that comprise soluble salts, e.g., chlorides, nitrates, etc., evaporated metal layers, ionic polymers such as those described in U.S. Pat. No. 2,861,056 and 3,206,312 or insoluble inorganic salts such as those described in U.S. Pat. No. 3,428,451.

Photothermographic Constructions

The photothermographic elements of this invention can be constructed of one or more layers on a support. Single layer constructions should contain the silver halide, the non-photosensitive, reducible silver source material, the reducing agent for the non-photosensitive reducible silver source, the binder as well as optional materials such as toners, coating aids, and other adjuvants. Two-layer constructions should contain silver halide and non-photosensitive, reducible silver source in one emulsion layer (usually the layer adjacent to the support) and some of the other ingredients in the second layer or both layers, although two layer constructions comprising a single emulsion layer coating containing all the ingredients and a protective topcoat are envisioned. Multicolor photothermographic dry silver constructions can contain sets of these bilayers for each color or they can contain all ingredients within a single layer, as described in U.S. Pat. No. 4,708,928. In the case of multilayer, multicolor photothermographic elements, the various emulsion layers are generally maintained distinct from each other by the use of functional or non-functional barrier layers between the various photosensitive layers, as described in U.S. Pat. No. 4,460,681.

Barrier layers, preferably comprising a polymeric material, can also be present in the photothermographic element of the present invention. Polymers for the material of the barrier layer can be selected from natural and synthetic polymers such as gelatin, poly(vinyl alcohols), poly(acrylic acids), sulfonated polystyrene, and the like. The polymers can optionally be blended with barrier aids such as silica. Alternatively, the formulation can be spray-dried or encapsulated to produce solid particles, which can then be redispersed in a second, possibly different, binder and then coated onto the support. The formulation for the emulsion layer can also include coating aids such as fluoroaliphatic polyesters.

Photothermographic emulsions used in the invention can be coated on a wide variety of supports. The support or substrate can be selected from a wide range of materials depending on the imaging requirement. Supports may be transparent or opaque. Typical supports include polyester film, subbed polyester film, poly(ethylene terephthalate) film, cellulose nitrate film, cellulose ester film, poly(vinyl acetal) film, polycarbonate film and related or resinous materials, as well as glass, paper, metal and the like. Typically, a flexible support is employed, especially a paper support, which can be partially acetylated or coated with baryta and/or an $\alpha$-olefin polymer, particularly a polymer of an $\alpha$-olefin containing 2 to 10 carbon atoms such as polyethylene, polypropylene, ethylene-butene copolymers, and the like. Preferred polymeric materials for the support include polymers having good heat stability, such as polyesters. A particularly preferred polyester is poly(ethylene terephthalate). A support with a backside resistive heating layer can also be used in color photothermographic imaging systems such as shown in U.S. Pat. No. 4,460,681 and 4,374,921.

Photothermographic emulsions used in this invention can be coated by various coating procedures including wire wound rod coating, dip coating, air knife coating, curtain coating, or extrusion coating using hoppers of the type described in U.S. Pat. No. 2,681,294. If desired, two or more layers can be coated simultaneously by the procedures described in U.S. Pat. No. 2,761,791 and British Patent No. 837,095. Typical wet thickness of the emulsion layer can be about 10–150 micrometers ($\mu$m), and the layer can be dried in forced air at a temperature of about 20°–100° C. It is preferred that the thickness of the layer be selected to provide maximum image densities greater than 0.2, and, more preferably, in the range 0.5 to 2.5, as measured by a MacBeth Color Densitometer Model TD 504 using the color filter complementary to the dye color.

Additionally, it may be desirable in some instances to coat different emulsion layers on both sides of a transparent support, especially when it is desirable to isolate the imaging chemistries of the different emulsion layers as disclosed in U.S. Pat. No. 5,264,321.

Development conditions will vary, depending on the construction used, but will typically involve heating the imagewise exposed material at a suitably elevated temperature. When used in a photothermographic element, the latent image obtained after exposure of the heat-sensitive construction can be developed by heating the material at a moderately elevated temperature of, for example, about 80°–250° C., preferably about 100°–200° C., for a sufficient period of time, generally about 1 second to about 2 minutes. Heating may be carried out by the typical heating means such as a hot plate, an iron, a hot roller, a heat generator using carbon or titanium white, or the like.

In some methods, the development is carried out in two steps. Thermal development takes place at a higher temperature, e.g., about 150° C. for about 10 seconds, followed by thermal diffusion at a lower temperature, e.g., about 80° C., in the presence of a transfer solvent. The second heating step at the lower temperature prevents further development and allows the dyes that are already formed to diffuse out of the emulsion layer to the receptor layer.

The Image-Receiving Layer

When the reactants and reaction products of photothermographic systems that contain compounds capable of being oxidized to form or release a dye remain in contact after imaging, several problems can result. For example, thermal development often forms turbid and hazy color images because of dye contamination by the reduced metallic silver image on the exposed area of the emulsion. In addition, the resulting prints tend to develop color in unimaged background areas. This is often referred to as "leuco dye backgrounding." This "background stain" is caused by slow post-processing reaction between the dye-forming or releasing compound and reducing agent. It is therefore often desirable to transfer the dye formed upon imaging to a receptor, or image-receiving layer.

Thus, the photothermographic element can further include an image-receiving layer. Images derived from the photothermographic elements employing reducing agents capable of being oxidized to form or release a dye am typically transferred to an image-receiving layer.

If used, dyes generated during thermal development of light-exposed regions of the emulsion layers migrate under development conditions into the an image-receiving or dye-receiving layer wherein they are retained. The dye-receiving layer can be composed of a polymeric material having affinity for the dyes employed. Necessarily, it will vary depending on the ionic or neutral characteristics of the dyes.

Sometimes, both the dye formed or released during thermal development as well as unreacted reducing agent capable of being oxidized to form or release a dye may migrate to the image receiving layer. Upon post-processing aging the reducing agent may continue to react and form or release dye. As noted above, the phthalimide-blocked post-processing stabilizers described herein may be incorporated into the image receiving layer. When so incorporated they further serve to prevent leuco dye backgrounding.

The image-receiving layer of this invention can be any flexible or rigid, transparent layer made of thermoplastic polymer. The image-receiving layer preferably has a thickness of at least about 0.1 $\mu$m, more preferably about 1–10 $\mu$m, and a glass transition temperature ($T_g$) of about 20°–200° C. In the present invention, any thermoplastic polymer or combination of polymers can be used, provided the polymer is capable of absorbing and fixing the dye. Because the polymer acts as a dye mordant, no additional fixing agents are required. Thermoplastic polymers that can be used to prepare the image-receiving layer include polyesters, such as polyethylene terephthalates; polyolefins, such as polyethylene; cellulosics, such as cellulose acetate, cellulose butyrate, and cellulose propionate; polystyrene; poly(vinyl chloride); poly(vinylidene chloride); poly(vinyl acetate); copolymer of vinyl chloride-vinyl acetate; copolymer of vinylidene chloride-acrylonitrile; copolymer of styrene-acrylonitrile; and the like.

The image-receiving layer can be formed by dissolving at least one thermoplastic polymer in an organic solvent (e.g., 2-butanone, acetone, tetrahydrofuran) and applying the resulting solution to a support base or substrate by various coating methods known in the art, such as curtain coating, extrusion coating, dip coating, air-knife coating, hopper coating, and any other coating method used for coating solutions. After the solution is coated, the image-receiving layer is dried (e.g., in an oven) to drive off the solvent. The image-receiving layer can be strippably adhered to the photothermographic element. Strippable image-receiving layers are described in U.S. Pat. No. 4,594,307.

Selection of the binder and solvent to be used in preparing the emulsion layer significantly affects the strippability of the image-receiving layer from the photosensitive element. Preferably, the binder for the image-receiving layer is impermeable to the solvent used for coating the emulsion layer and is incompatible with the binder used for the emulsion layer. The selection of the preferred binders and solvents results in weak adhesion between the emulsion layer and the image-receiving layer and promotes good strippability of the emulsion layer.

The photothermographic element can also include coating additives to improve the strippability of the emulsion layer. For example, fluoroaliphatic polyesters dissolved in ethyl acetate can be added in an amount of about 0.02–0.5 weight percent of the emulsion layer, preferably about 0.1–0.3 weight percent. A representative example of such a fluoroaliphatic polyester is "Fluorad TM FC 431" (a fluorinated surfactant available from Minnesota Mining and Manufacturing Company, St. Paul, Minn.). Alternatively, a coating additive can be added to the image-receiving layer in the same weight range to enhance strippability. No solvents need to be used in the stripping process. The strippable layer preferably has a delaminating resistance of about 1–50 g/cm and a tensile strength at break greater than, preferably at least two times greater than, its delaminating resistance.

The image-receiving layer may be adjacent to the emulsion layer in order to facilitate transfer of the dye that forms after the imagewise exposed emulsion layer is subjected to thermal development, for example, in a heated shoe-and-roller-type or heated drum-type heat processor.

Photothermographic multi-layer constructions containing blue-sensitive emulsions containing a yellow dye-forming or dye-releasing compound can be overcoated with green-sensitive emulsions containing a magenta dye-forming or dye-releasing compound. These layers can in turn be overcoated with a red-sensitive emulsion layer containing a cyan dye-forming or dye-releasing compound. Imaging and heating to form or release the yellow, magenta, and cyan dyes in an imagewise fashion. The dyes so formed or released may migrate to an image-receiving layer. The image-receiving layer can be a permanent part of the construction or it can be removable, "i.e., strippably adhered," and subsequently peeled from the construction. Color-forming layers can be maintained distinct from each other by the use of functional or non-functional barrier layers between the various photosensitive layers as described in U.S. Pat. No. 4,460,681. False color address, such as that shown in U.S. Pat. No. 4,619,892, can also be used rather than blue-yellow, green-magenta, or red-cyan relationships between sensitivity and dye formation or release. False color address is particularly useful when imaging is performed using longer wavelength light sources, especially red or near infrared light sources, to enable digital address by lasers and laser diodes.

If desired, the dyes formed or released in the emulsion layer can be transferred onto a separately coated image-receiving sheet by placing the exposed emulsion layer in intimate face-to-face contact with the image-receiving sheet and heating the resulting composite construction. Good results can be achieved in this second embodiment when the layers are in uniform contact for a period of time of about 0.5–300 seconds at a temperature of about 80°–220° C.

In another embodiment, a multi-colored image can be prepared by superimposing in register a single image-receiving sheet successively with two or more imagewise exposed photothermographic elements, each of which forms or releases a dye of a different color, and heating to transfer the thus formed or released dyes as described above. This method is particularly suitable for the production of color proofs especially when the dyes formed or released have hues that match the internationally agreed standards for color reproduction (Standard Web Offset Press colors or SWOP colors). Dyes with this property are disclosed in U.S. Pat. No. 5,023,229. In this embodiment, the photothermographic elements are preferably all sensitized to the same wavelength range regardless of the color of the dye formed or released. For example, the elements can be sensitized to ultraviolet radiation with a view toward contact exposure on conventional printing frames, or they can be sensitized to longer wavelengths, especially red or near infra-red, to enable digital address by lasers and laser diodes. As noted above, false color address is again particularly useful when imaging is performed using longer wavelength light sources, especially red or near infrared light sources, to enable digital address by lasers and lasser diodes.

Objects and advantages of this invention will now be illustrated by the following examples, but the particular materials and amounts thereof recited in these examples, as well as other conditions and details, should not be construed to unduly limit this invention.

EXAMPLES

These examples provide exemplary synthetic procedures for compounds of the invention. Photothermographic imaging constructions are shown.

All materials used in the following examples were readily available from standard commercial sources, such as Aldrich Chemical Co. (Milwaukee, Wis.), unless otherwise specified. All percentages are by weight unless otherwise indicated. The following additional terms and materials were used.

Acryloid TM A-21 and B-72 are poly(methyl methacrylate) polymers available from Rohm and Haas, Philadelphia, Pa.

Airvol TM 523 is a poly(vinyl alcohol) available from Air Products.

Butvar TM B-72, B-76, and B-79 are poly(vinyl butyral) resins available from Monsanto Company, St. Louis, Mo.

CA 398-6 is a cellulose acetate polymer available from Eastman Chemical Co., Kingsport, Tenn. CAO-5 TM is bis(2-hydroxy-3-t-butyl-5-methylphenyl)methane, an antioxidant available from Rohm and Haas, Philadelphia, Pa. It is a reducing agent for the non-photosensitive reducible source of silver and has the following structure:

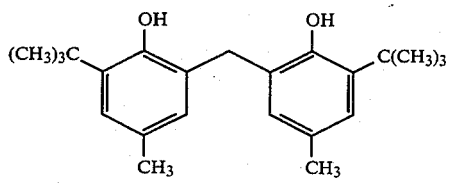

CBBA is 2-(4-chlorobenzoyl)benzoic acid.

Fluorad TM FC-431 is a fluorochemical surfactant available from 3M Company, St. Paul, Minn.

$HgC_2H_3O_2$ is mercuric acetate.

MEK is methyl ethyl ketone (2-butanone).

MMBI is 5-methyl-2-mercaptobenzimidazole.

PAZ is 1-(2H)-phthalazinone.

Permanax TM WSO is 1,1-bis(2-hydroxy-3,5-dimethylphenyl)-3,5,5-trimethylhexane [CAS RN=7292-14-0] and is available from Vulnax International, Ltd. It is also known as Nonox TM. It is a reducing agent for the non-photosensitive reducible source of silver.

PET is poly(ethylene terephthalate).

PHZ is phthalazine.

PVP K-90 is a poly(vinyl pyrrolidone) available from International Specialty Products.

Scripset TM 640 is an esterified styrene-maleic anhydride resin available from Monsanto Corporation, St. Louis Mo.

Styron TM 685 is a polystyrene resin available from Dow Chemical Company, Midland, Mich.

Syloid TM 244 is a colloidal silica available from W. R. Grace and Company, Boca Raton, Fl.

Sensitizing Dye-1 is a red sensitizing dye and was prepared as disclosed in U.S. Pat. No. 3,719,495 and has the following structure:

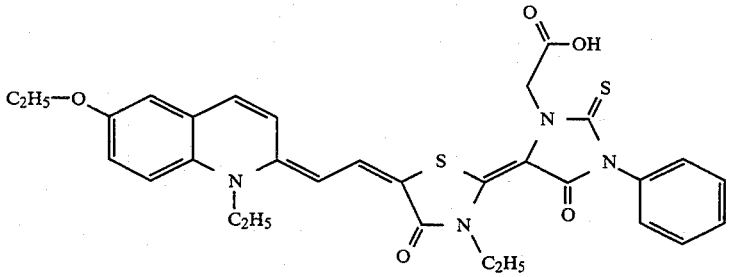

Compound-A has the following structure:

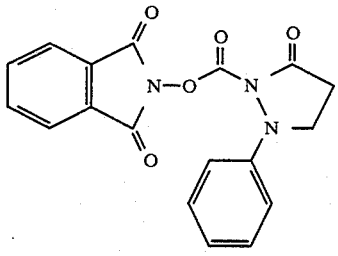

Compound-B is a compound capable of releasing a stabilizer with heat under development conditions of the photothermographic element. It was prepared according to U.S. Pat. No. 5,194,623 and has the following structure:

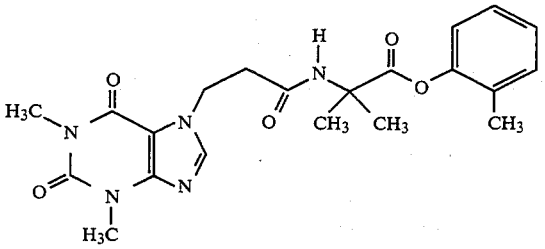

Compound-C is a tris-phthalimide blocked 1,1,1-tris-(4-hydroxyphenyl)ethane (THPE) and has the following structure:

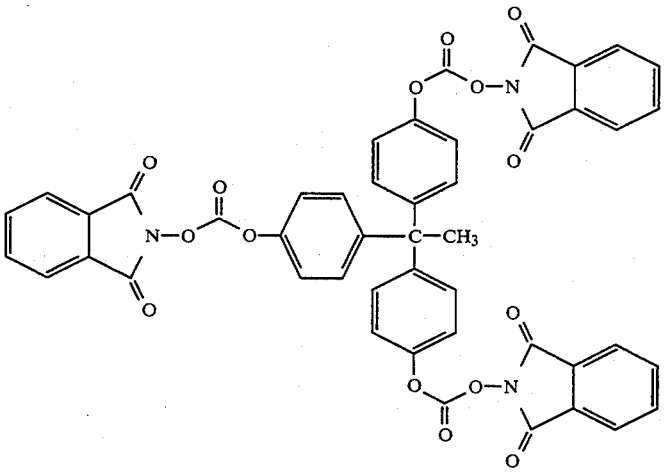

"Hydroxy cyan" is a leuco oxazine dye described in U.S. Pat. No. 4,782,010 and has the following formula:

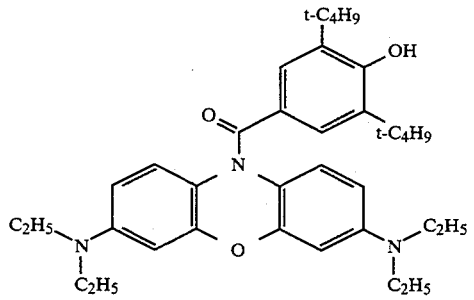

The following definitions are used in the sensitometry measurements:

Speed 2 is the log exposure corresponding to a density of 0.60 above Dmin.

Toe 2 is the slope of the line joining the density points at 0.30 above Dmin and 0.25 log E before the log E value corresponding to a density of 0.30 above Dmin.

AC 2 is the slope of the line joining the density points of 0.60 and 1.20 above Dmin.

The Green filter used was a Wratten #58.

The Blue filter used was a Wratten #47B.

The Red filter used was a Wratten #25.

Preparation of Compounds

Preparation of Compound A

A solution of 21 mL of phosgene (17% in dichloromethane) was added dropwise over 0.5 hr to a solution of 4.86 g of phenidone (1-phenyl-3-pyrazolidinone) and 3.75 g of triethylamine in 50 mL of dichloromethane maintained at 0°–5° C. by an ice-water bath. An additional 3.75 g of triethylamine was added and the resultant red suspension was stirred for an additional 0.5 hr at 0°–5° C. Finely ground N-hydroxyphthalimide (4.89 g) was added portionwise. After stirring for 1 hr, the reaction mixture was quenched by addition of ice cold water. The organic layer was separated and washed repeatedly with ice-cold water until the organic layer was almost colorless. The organic layer was removed and dried over anhydrous magnesium sulfate. Filtration to remove drying agent was followed by solvent removal at reduced pressure. The resultant foamy solid was dissolved in 100 mL of chloroform, 5–10 mL of hexanes was added, and the solution stirred. A colorless crystalline material gradually separated. The material was filtered off and dried in air to afford 3.5 g of Compound A; m.p. 214°–215° C.

Preparation of Compound B

Compound B was prepared as described in U.S. Pat. No. 5,194,623.

Preparation of Compound C

The following synthesis exemplifies application of N-carbonyloxyphthalimide as a protecting group for 1,1,1-tris(4-hydroxyphenyl)ethane (THPE). THPE is used as antifoggant and post-processing stabilizer in Dry Silver formulations. After exposure and development, phthalimede-blocked THPE is believed to slowly release THPE under ambient light to enhance the print stability properties without adversely affecting the sensitometric properties of the photothermographic element.

Preparation of N-chlorocarbonyloxyphthalimide

To an ice-cooled solution of 6.5 g (40 retool) of N-hydroxyphthalimide in 200 mL dry tetrahydrofuran (THF) was added 10.0 mL (15.8 g, 80 mmole) of trichloromethyl chloroformate (diphosgene). The solution was then stirred for 6 hrs at room temperature. The solvent and excess trichloromethyl chloroformate were removed under reduced pressure to give a white crystalline solid, which was recrystallized from dry n-hexane to give colorless plates; m.p. 113°–115° C.

Reaction of THPE with N-Chlorocarbonyloxyphthalimide to give Phthalimide Blocked THPE A mixture of 0.9 g (3 retool) of 1,1,1-tris(4-hydroxyphenyl) ethane and 1.1 g (10 mmol) of triethylamine in 20 mL of dry THF was cooled with an ice-water bath and 2.25 g (10 retool) of N-chlorocarbonyloxyphthalimide was added. The mixture was cooled by stirring for 15 minutes and stirring was continued at room temperature for 45 minutes. Precipitated triethylamine hydrochloride was removed by filtration and washed with THF. The filtrate was concentrated under reduced pressure. Addition of petroleum ether gave colorless white crystals.

Evaluation of Stabilizers

Densitometry measurements were made on a custom-built computer-scanned densitometer and are believed to be comparable to measurements obtainable from commercially available densitometers.

Examples 1–3 demonstrate the use of phthalimide blocked post-processing stabilizers in color photothermographic elements. Example 4 demonstrates the use of a phthalimide blocked post-processing stabilizer in a black-and-white photothermographic element.

Example 1

The following example demonstrates that phthalimide-blocked 1-phenyl-3-pyrazolidinone prevents leuco-dye backgrounding (Sample B) while free, unblocked 1-phenyl-3-pyrazolidinone (Sample C) fogs the photothermographic element.

A dispersion of silver behenate half soap was made to 10.83% solids in toluene and ethanol (10/90) by homogenization and contained 0.75% by weight Butvar TM B-72. To 76.3 g of the silver half soap dispersion was added 135.1 g ethanol and 57.1 g isopropanol. After 15 minutes of mixing, 2.82 mL of a mercuric bromide solution (0.192 g/10 mL methanol) was added. Then an additional 2.82 mL of the metcurie bromide (0.192 g/10 nil methanol) solution was added 15 minutes later. After 60 minutes of mixing, 26.97 g of Butvar TM B-72 was added. To 41.16 g of the prepared silver premix described above was added a cyan color-forming leuco dye solution as shown below.

| Component | Amount |
|---|---|
| Hydroxy Cyan | 0.396 g |
| Toluene | 6.00 g |
| Acryloid TM B-72 | 1.23 g |

After the addition of the Hydroxy Cyan premix solution, 1.21 g of the sensitizing Dye-1 (0.0166% in methanol/toluene 25/75) was added and allowed to sensitize for 30 minutes.

A topcoat solution was prepared by adding the following components into a blender and mixed at high speed for 30 minutes.

| Component | Amount |
|---|---|
| Ethanol | 210.63 g |
| Methanol | 230.63 g |
| Syloid TM 244 | 44.00 g |
| Scripset TM 640 | 63.00 g |

To the topcoat premix was added while mixing the following materials.

| Component | Amount |
|---|---|
| Ethanol | 631.75 g |
| Methanol | 691.75 g |
| Scripset TM 640 | 594.00 g |
| Phthalic Acid | 51.50 g |
| Benzotriazole | 5.25 g |

After 60 minutes of mixing, a solution of Fluorad TM FC 431 was added to the topcoat (17.0 g/17.0 g methanol).

Three 6.66 g aliquots of the topcoat solution described above were taken. To the first was added 3.34 g of methanol (Sample A); this sample has no stabilizer in the formulation and serves as a control. To the second aliquot was added 0.021 g of Compound A dissolved in 2.33 g of 2-butanone and 1.00 g of methanol (Sample B); this sample has a phthalimide blocked 1-phenyl-3-pyrazolidinone stabilizer of the invention. To the third aliquot was added 0.035 g of 1-phenyl-3-pyrazolidinone dissolved in 3.34 g of methanol (Sample C); this sample uses an unblocked post-processing stabilizer.

A double-knife coater was used to coat the photothermographic emulsion and topcoat layers. A support was cut to a length suitable to the volume of solution used, and after raising the hinged knives, placed in position on the coater bed. The knives were then lowered and locked into place. The height of the knives was adjusted with wedges controlled by screw knobs and measured with electronic gauges. The knives were zeroed onto the support and knife #1 was raised to a clearance corresponding to the desired wet thickness of photothermographic emulsion layer #1, 2.0 mil (50.8/μm). Knife #2 was raised to a height equal to the desired wet thickness of layer #1 plus the desired wet thickness of topcoat layer #2, 1.5 rail (38.1/μm). Aliquots of solutions of photothermographic emulsion layer and topcoat layer were simultaneously poured onto the support in front of the corresponding knives. The support was immediately drawn past the knives so that a double coating was produced. The coated support was then dried for 3 minutes at 180° F. (82.2° C.).

Samples from the coating were exposed using an EG&G sensitometer for $10^{-3}$ seconds through a Wratten #25 red filter and 0–3 continuous density wedge. The samples were then processed for approximately six seconds by heating at 135° C. in a 3M Model 9014 Dry Silver processor. A cyan image was observed to have formed in the areas corresponding to red light exposure.

The following sensitometric data were obtained from the sample:

| Sample | Filter | Dmin | Dmax | Spd 2 | Toe 2 | AC 2 |
|---|---|---|---|---|---|---|
| A | Red | 0.19 | 2.14 | 2.15 | 0.91 | 2.74 |
| B | Red | 0.19 | 2.20 | 2.09 | 0.89 | 2.78 |
| C | Sample C fogged completely during the drying step. | | | | | |

Post-processing stability was measured by exposing the samples to 100 foot candles of light for 7 days at 75% relative humidity and 75° F. The Dmin and Dmax measurements after this test were:

| Sample | Filter | Dmin | Dmax |
|---|---|---|---|
| A | Red | 0.57 | 2.12 |
| B | Red | 0.43 | 2.15 |

Example 2

This example shows that addition of Compound A reduces the leuco-dye backgrounding of a cyan dye (red filter) when compared to a control with no stabilizer added.

A photothermographic emulsion was prepared as in Example 1.

Two 6.66 g aliquots of the topcoat solution prepared as described above in Example 1 were taken. To the first was added 3.34 g of methanol (Sample D); this sample has no stabilizer in the formulation and serves as a control. To the second aliquot was added 0.021 g of Compound A dissolved in 3.33 g of N,N-dimethylformamide (Sample E); this sample has a phthalimide blocked 1-phenyl-3-pyrazolidinone stabilizer of the invention.

Aliquots of solutions of photothermographic emulsion layer and topcoat layer were simultaneously double-knife coated as described above in Example 1. The photothermographic emulsion layer and topcoat layers were coated at a wet thickness of 2.0 mil (50.8 μm) and 1.5 mil (38.1 μm) respectively. The web was then dried for 3 minutes at 180° F. (82.2° C.).

Samples from the coating were exposed to an EG&G sensitometer for $10^{-3}$ seconds through a Wratten//25 red filter and 0–3 continuous density wedge. The samples were then processed for approximately six seconds by heating at 135° C. in a 3M Model 9014 Dry Silver processor. A cyan image was observed to have formed in the areas corresponding to red light exposure.

The following sensitometric data were obtained from the sample:

| Sample | Filter | Dmin | Dmax | Spd 2 | Toe 2 | AC 2 |
|---|---|---|---|---|---|---|
| D | Red | 0.16 | 1.91 | 2.07 | 0.76 | 1.94 |
| E | Red | 0.17 | 1.74 | 2.02 | 0.81 | 1.70 |

Post-processing stability was measured by exposing the samples to 100 foot candles of light for 7 days at 75% relative humidity and 75° F. The Dmin and Dmax measurements after this test were:

| Sample | Filter | Dmin | Dmax |
|---|---|---|---|
| D | Red | 0.53 | 1.86 |
| E | Red | 0.35 | 1.70 |

Example 3

This example demonstrates that the stabilization effect is still present at other intensities of light. This example also demonstrates that additional incorporation of of heat-released stabilizers (Compound B) along with the light-released stabilizers of this invention provides improved high intensity light stabilization.

A photothermographic emulsion was prepared as described in above in Example 1. To 10.0 g of the dispersion the following were added:

Sample F. Nothing. This sample contains no stabilizer and serves as a control.

Sample G. 1.0 mL of a premix containing 0.160 g of diazabicyclo-[2.2.2]octane in 4.0 mL of methanol.

Two 5.00 g aliquots of the topcoat solution prepared as described above in Example 1 were taken. To the first were added 2.50 g of methanol and 2.5 g of ethanol (Sample F); this sample has no stabilizer in the formulation and serves as a control. To the second aliquot were added 0.021 g of Compound A dissolved in 3.50 g of 2-butanone, 1.50 g of N,N-dimethylformamide, and 0.185 g of Compound B (Sample G); this sample has a phthalimide blocked 1-phenyl-3-pyrazolidinone stabilizer of the invention.

Aliquots of solutions of photothermographic emulsion layer and topcoat layer were simultaneously double-knife coated as described above in Example 1. The photothermographic emulsion layer and topcoat layers were coated at a wet thickness of 2.0 rail (50.8/μm) and 1.5 rail (38.1/μm) respectively. The web was then dried for 3 minutes at 180° F. (82.2° C.).

Samples from the coating were exposed to an EG&G sensitometer for $10^{-3}$ seconds through a Wratten #25 red filter and 0–3 continuous density wedge. The samples were then processed for approximately six seconds by heating at 135° C. in a 3M Model 9014 Dry Silver processor. A cyan image was observed to have formed in the areas corresponding to red light exposure.

The following sensitometric data were obtained from the sample:

| Sample | Filter | Dmin | Dmax | Spd 2 | Toe 2 | AC 2 |
|---|---|---|---|---|---|---|
| F | Red | 0.15 | 2.21 | 2.20 | 0.96 | 4.13 |
| G | Red | 0.15 | 1.83 | 2.14 | 0.97 | 2.37 |

Post-processing stability was measured by exposing the samples to 1200 foot candles of light for 24 hours at 65 % relative humidity and 27° C. The Dmin and Dmax measurements after this test were:

| Sample | Filter | Dmin | Dmax |
|---|---|---|---|
| F | Red | 0.75 | 2.14 |
| G | Red | 0.50 | 1.79 |

Example 4

The following Example demonstrates the use of phthalimide blocked stabilizers in a protective topcoat of a black-and-white photothermographic element.

A 13.6 wt% dispersion of silver behenate/behenic acid half soap was made in acetone by homogenization. To 201.5 g of this dispersion was added Butvar TM B-76 (1.12 g) and the mixture was stirred 30 minutes more. Three 1.00 mL aliquots of a solution of 10.0 g zinc bromide in 100.0 mL methanol were added sequentially with stirring for 10 minutes after each addition. Toluene (66.66 g) was added and the mixture was stirred for an additional 15 minutes. A solution (2.40 mL) containing 4.00 g of pyridine in 100 mL 2-butanone was added with continued stirring for 15 minutes. The mixture was allowed to stand for 4 hours.

Butvar TM B-76 (31.75 g) was added and the mixture then stirred for 30 minutes. This was followed by the addition of 2.73 mL of a solution of 1.33 g N-bromosuccinimide in 100 mL methanol. CAO-05 TM (4.20 g, an antioxidant purchased from Rohm and Haas Co., Philadelphia, Pa.) was added with stirring for 5 minutes. Acryloid TM A-21 (27.22 g, also from Rohm and Haas) was added with stirring for 5 minutes.

The following steps were carried out under green safelights.

A 6.00 mL aliquot of a solution of 0.03 g Sensitizing Dye-1, 25.00 mL methanol, and 75 mL toluene was added to the above mixture and the mixture was stirred for 5 minutes. The viscosity of the resultant solution should be between 180 and 220 centipoise. If the viscosity is greater than 220 centipoise, acetone should be added to bring the viscosity into the desired range.

The photothermographic formulation thus prepared was coated at 4.4 mils (112/μm) wet thickness (to give a dry coating weight of 1.25 g/ft$^2$) onto paper and dried at 180° F. (82.2° C.) for one minute.

A topcoat solution was coated onto the photothermographic emulsion samples prepared above. A master batch of topcoat solution was prepared by mixing: 164.728 g acetone, 82.350 g 2-butanone, 33.300 g methanol, 13.500 g CA 398-6 (a cellulose acetate, Eastman Chemical), 1.542 g phthalazine, 1.068 g 4-methylphthalic acid, 0.636 g tetrachlorophthalic acid, and 0.800 g tetrachlorophthalic anhydride. To 42.000 g of this master batch of topcoat solution was added 0.210 g of 2-tribromomethylsulfonyl quinaldine and stirring was allowed to continue for 10 minutes.

Four 7.00 g aliquots of the topcoat solution were taken. To one was added 1,1,1-Tris(4-hydroxyphenyl)ethane (THPE). To the other solutions was added Compound C (tris-phthalimide blocked-THPE). The compounds were compared at concentration levels of 0.8, 0.2, and 0.05 retool/100.00 g of topcoat solution.

The topcoat formulation was coated at 2.8 mils (71.1/μm), wet thickness, on top of the silver emulsion and dried for 3 minutes at 70° C. to provide a dry coating weight of 0.24 g/ft$^2$.

The coated paper was imaged by exposing using a photometric sensitometer with a Eastman Kodak #101 tungsten light source. After exposure, the strips (each 1 inch×7 inches) were processed at 250° F. (121° C.) by heating for 6 seconds in a 3M Model 9014 Dry Silver processor. The images obtained were evaluated by a computer densitometer. Sensitometric results include Drain, Dmax and Speed. In these samples, the lower the speed number, the "faster" the paper. The sensitometric properties of one day "naturally aged" samples, shown below in Table 1, demonstrate that initially 1,1,1-Tris(4-hydroxyphenyl)ethane and Compound-C are better than or equal to the control for Drain sensitometric improvements. However, as the samples naturally-age for seven days the unblocked "parent" compound ( 1,1,1-tris-(4-hydroxyphenyl)ethane–0.8 mmols) was found to have a significant drop for both the Dmax and Speed. In Compound-C, this drop in both the Dmax and speed was not observed at any of the concentration levels tested.

TABLE 1

| Compound | Sensitometric Results Amount | Dmin | Dmax | Speed* |
|---|---|---|---|---|
| 1 Day Naturally Aged | | | | |
| 1,1,1-Tris(4-hydroxyphenyl)ethane | 0.0000 g | 0.14 | 1.67 | 0.73 |
| | 0.0350 g (0.8 mmol) | 0.12 | 1.81 | 0.78 |
| Blocked Compound-C | 0.0000 g | 0.14 | 1.67 | 0.73 |
| | 0.0030 g | 0.14 | 1.81 | 0.70 |
| | 0.0120 g | 0.13 | 1.79 | 0.72 |
| | 0.0480 g (0.8 mmol) | 0.12 | 1.80 | 0.83 |
| 7 Day Naturally Aged | | | | |
| 1,1,1-Tris(4-hydroxyphenyl)ethane | 0.0000 g | 0.19 | 1.77 | 0.78 |
| | 0.0350 g (0.8 mmol) | 0.08 | 0.87 | 1.12 |
| Blocked Compound-C | 0.0000 g | 0.19 | 1.77 | 0.78 |
| | 0.0030 g | 0.18 | 1.76 | 0.72 |
| | 0.0120 g | 0.17 | 1.72 | 0.73 |
| | 0.0480 g (0.8 mmol) | 0.13 | 1.71 | 0.84 |

*Speed is Log E corresponding to density of 0.6 above Dmin. E is exposure in ergs/cm$^2$.

The seven day naturally-aged samples were used in the testing of print stability. In the first test, these samples were exposed under room light conditions (100 foot-candles) at room temperature for 3 days. The initial optical density of the samples were measured on a Macbeth Model TR924 Densitometer using the visible filter. After 72 hours the samples were removed and measured again on the Macbeth Model TR924 Densitometer. The optical density results for this test are shown below in Table 2; ΔDmin=Drain (Final)—Drain (Initial).

The results demonstrate that Compound-C of the invention is better than both 1,1,1-tris(4-hydroxyphenyl)ethane (parent compound) and a control containing no stabilizer for improving print stability. The print stability improves as the amount of blocked Compound-C is increased in the system. When measured with the visible filter, the observed print stability improvements are from 50% (0.0030 g) to 70% (0.0480 g) compared to the control containing no stabilizer.

TABLE 2

| Compound | Optical Density Amount | Δ Dmin Visible Filter |
|---|---|---|
| 1,1,1-Tris(4-hydroxyphenyl) ethane | 0.0000 g | 0.10 |
| | 0.0350 g (0.8 mmol) | 0.03 |
| Compound-C - Phthalimide blocked 1,1,1-Tris(4-hydroxyphenyl)ethane | 0.0000 g | 0.10 |
| | 0.0030 g | 0.05 |
| | 0.0120 g | 0.04 |
| | 0.0480 g (0.8 mmol) | 0.03 |

In a second print stability test, samples were placed in a heat and light chamber maintained at 45° C. and 25% RH, and illuminated at 1200 foot-candles. The density of the samples were again measured on a Macbeth TR924 densitometer using the visible filters. After 24 hours the samples were removed and again measured on the Macbeth TR924 sensitometer. The optical density results for this test are found below in Table 3; ΔDmin=Drain (Final)—Drain (Initial).

These results again demonstrate that Compound-C of the invention is better than both 1,1,1-tris(4-hydroxyphenyl)ethane (parent compound) and a control containing no stabilizer for improving print stability. The print stability improves as the amount of the blocked compound is increased in the photothermographic element. When measured with the visible filter, the observed print stability improvements are from 36% (0.0030 g) to 53% (0.0480 g) compared with a control containing no stabilizer.

TABLE 3

| Compound | Optical Density Amount | Δ Dmin Visible Filter |
|---|---|---|
| 1,1,1-Tris(4-hydroxyphenyl)ethane | 0.0000 g | 0.30 |
| | 0.0350 g (0.8 mmol) | 0.14 |
| Blocked with Compound-C | 0.0000 g | 0.30 |
| | 0.0030 g | 0.19 |
| | 0.0120 g | 0.17 |
| | 0.0480 g (0.8 mmol) | 0.14 |

Reasonable modifications and variations are possible from the foregoing disclosure without departing from either the spirit or scope of the present invention as defined by the claims.

What is claimed is:

1. A photothermographic element comprising a support bearing at least one photosensitive, image-forming photothermographic-emulsion layer comprising:
   (a) a photosensitive silver halide;
   (b) a non-photosensitive, reducible silver source;
   (c) a reducing agent for said non-photosensitive, reducible silver source;
   (d) a binder; and
   (e) a compound capable of releasing a post-processing stabilizer having a nucleus of the formula:

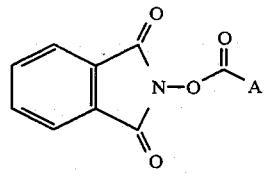

wherein:

A represents any monovalent group for which the corresponding compound AH functions as a post-processing stabilizer.

2. The element of claim 1 wherein AH is selected from the group consisting of benzimidazoles, triazoles, benzotriazoles, tetrazoles, triazines, thiazolines, 3-pyrazolidinones, indazoles, hypoxanthines, imidazoles, and hydroxyarylalkanes.

3. The element of claim 2 wherein AH is selected from the group consisting of benzimidazoles, triazoles, benzotriazoles, tetrazoles, 1-phenyl-3-pyrazolidinones, imidazoles, and hydroxyarylalkanes.

4. The element of claim 1 adhered as to a support at least one layer.

5. The photothermographic element according to claim 1 wherein said silver halide is silver bromide, silver chloride, or silver iodide or mixtures thereof.

6. The photothermographic element according to claim 1 wherein said non-photosensitive, reducible source of silver is a silver salt of a carboxylic acid having from one to 30 carbon atoms.

7. The photothermographic element according to claim 1 wherein said reducing agent is a compound capable of being oxidized to form or release a dye or is capable of reducing silver ion.

8. The photothermographic element according to claim 7 wherein said compound capable of being oxidized is a leuco dye.

9. The photothermographic element according to claim 1 wherein said binder is hydrophilic.

10. The photothermographic element according to claim 1 wherein said binder is hydrophobic.

11. A photothermographic element comprising one layer or two adjacent layers coated on a support wherein the photothermographic element comprises:

(a) a photosensitive silver halide;

(b) a non-photosensitive, reducible silver source;

(c) a reducing agent for said non-photosensitive, reducible silver source;

(d) a binder; and (e) a compound capable of releasing a post-processing stabilizer having a nucleus of the formula:

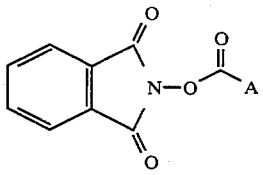

wherein:

A represents any monovalent group for which the corresponding compound AH functions as a post-processing stabilizer.

12. The element of claim 11 wherein AH is selected from the group consisting of benzimidazoles, triazoles, benzotriazoles, tetrazoles, triazines, thiazolines, 3-pyrazolidinones, indazoles, hypoxanthines, imidazoles, and hydroxyarylalkanes.

13. The element of claim 12 wherein AH is selected from the group consisting of benzimidazoles, triazoles, benzotriazoles, tetrazoles, 1-phenyl-3-pyrazolidinones, imidazoles, and hydroxyarylalkanes.

14. The element of claim 11 where said adjacent layer is a protective topcoat layer.

15. The photothermographic element according to claim 11 wherein said silver halide is silver bromide, silver chloride, or silver iodide or mixtures thereof.

16. The photothermographic element according to claim 11 wherein said non-photosensitive, reducible source of silver is a silver salt of a carboxylic acid having from one to 30 carbon atoms.

17. The photothermographic element according to claim 11 wherein said reducing agent is a compound capable of being oxidized to form or release a dye or is capable of reducing silver ion.

18. The photothermographic element according to claim 17 wherein said compound capable of being oxidized is a leuco dye.

19. The photothermographic element according to claim 11 wherein said binder is hydrophilic.

20. The photothermographic element according to claim 11 wherein said binder is hydrophobic.

21. A photothermographic element comprising one layer or two layers coated on the same side of a support wherein said one or two layers comprise:

(a) a photosensitive silver halide;

(b) a non-photosensitive, reducible silver source;

(c) a reducing agent for said non-photosensitive, reducible silver source;

(d) a binder; and (e) a compound capable of releasing a post-processing stabilizer having a nucleus of the formula:

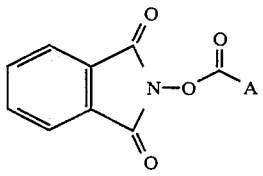

wherein:

A represents any monovalent group for which the corresponding compound AH functions as a post-processing stabilizer.

22. A photothermographic element comprising:

(a) a support bearing at least one photosensitive, image-forming, photothermographic emulsion layer comprising:

(i) a photosensitive silver halide;

(ii) a non-photosensitive, reducible silver source;

(iii) a reducing agent for said non-photosensitive, reducible silver source; and (iv) a binder; and (b) an image receiving layer comprising a compound capable of releasing a post-processing stabilizer having a nucleus of the formula:

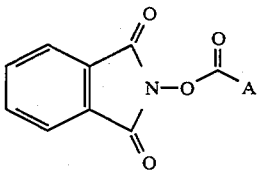

wherein:

A represents any monovalent group for which the corresponding compound AH functions as a post-processing stabilizer.

* * * * *